US009280985B2

(12) United States Patent
Tawada

(10) Patent No.: US 9,280,985 B2
(45) Date of Patent: Mar. 8, 2016

(54) NOISE SUPPRESSION APPARATUS AND CONTROL METHOD THEREOF

(71) Applicant: CANON KABUSHIKI KAISHA, Tokyo (JP)

(72) Inventor: Noriaki Tawada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 144 days.

(21) Appl. No.: 14/139,527

(22) Filed: Dec. 23, 2013

(65) Prior Publication Data

US 2014/0185826 A1 Jul. 3, 2014

(30) Foreign Application Priority Data

Dec. 27, 2012 (JP) ..... 2012-286162

(51) Int. Cl.
*G10L 21/0232* (2013.01)
*G10L 21/0216* (2013.01)

(52) U.S. Cl.
CPC ... *G10L 21/0232* (2013.01); *G10L 2021/02166* (2013.01)

(58) Field of Classification Search
USPC ..... 381/92–95
See application file for complete search history.

(56) References Cited

U.S. PATENT DOCUMENTS

| | | | | |
|---|---|---|---|---|
| 6,339,758 | B1 * | 1/2002 | Kanazawa | G10L 21/02 381/94.3 |
| 8,532,308 | B2 | 9/2013 | Tawada | |
| 2003/0177007 | A1 | 9/2003 | Kanazawa et al. | |
| 2009/0175466 | A1 * | 7/2009 | Elko | H04R 3/005 381/94.2 |
| 2012/0063605 | A1 | 3/2012 | Tawada | |
| 2013/0073283 | A1 * | 3/2013 | Yamabe | G10L 21/0216 704/226 |

FOREIGN PATENT DOCUMENTS

JP 2003-271191 A 9/2003

* cited by examiner

*Primary Examiner* — Brenda Bernardi
(74) *Attorney, Agent, or Firm* — Fitzpatrick, Cella, Harper & Scinto

(57) ABSTRACT

A noise suppression apparatus selectively uses an adaptive beamformer and fixed beamformer for each frequency. A direction of a null of the fixed beamformer is determined from a direction of a null automatically formed by the adaptive beamformer. Filter coefficients of the adaptive beamformer based on an output power minimization rule are calculated by a minimum norm method using a norm of the filter coefficients as a constraint. The above selection is made based on, for example, a depth of a null automatically formed by the adaptive beamformer in the selection.

13 Claims, 10 Drawing Sheets

NOISE SUPPRESSION APPARATUS AND CONTROL METHOD THEREOF

BACKGROUND OF THE INVENTION

1. Field of the Invention

The present invention relates to a noise suppression technique for suppressing noise from an audio signal.

2. Description of the Related Art

A technique for suppressing unnecessary noise from an audio signal is important to enhance perceptual quality of a target sound included in an audio signal and to improve a recognition ratio in speech recognition.

As a representative technique for suppressing noise from an audio signal, a beamformer is known. The beamformer applies filtering to each of a plurality of microphone signals acquired by a plurality of microphones, and then adds up the filtered signals to obtain a single output signal. This technique is called "beamformer" because the filtering and addition processes correspond to formation of a spatial beam pattern having directivity, that is, direction selectivity by the plurality of microphones.

A portion where a gain of the beam pattern reaches a peak is called a main lobe, and when the beamformer is configured to be directed in a direction of a target sound, the target sound can be emphasized, and noise which exists in directions different from the target sound can be suppressed at the same time.

However, the main lobe of the beam pattern has a wide width especially when the number of microphones is small. A non-directional sound source having no directivity such as wind noise outdoors can be considered as a spatially omnidirectionally distributed noise source. For this reason, even when a moderate main lobe of the beam pattern is used, non-directional noise such as wind noise cannot be sufficiently suppressed.

Thus, a noise suppression method using a null as a portion where the gain of a beam pattern reaches a dip in place of the main lobe has been proposed.

FIG. 2A shows an example of a beam pattern in a horizontal direction at about 3.3 kHz on a polar coordinate system when the number of microphones is two. Assume that two microphones are disposed to be spaced apart from each other on a line segment which connects −90° and 90°. Note that beam patterns in semicircles in 0° and 180° directions with respect to the line segment are symmetrical patterns.

As can be seen from FIG. 2A, although a main lobe in a 90° direction has a very wide width, the gain of a null in a −30° direction is sharply declined, and only a sound in this direction is nearly not output. As a representative target sound included in microphone signals, a voice is known. A voice uttered by a person is a directional sound source which is spatially concentrated on one point. Thus, the following noise suppression method by means of two-step processes has been proposed (for example, Japanese Patent Laid-Open No. 2003-271191). That is, by directing the null of the beam pattern to a directional target sound, non-directional noise is extracted first, and then the extracted noise is subtracted from microphone signals.

In FIG. 2A, a non-directional noise source such as wind noise is expressed by marks "~" as a spatially omnidirectionally distributed noise source. Also, a human voice as a directional target sound located in the −30° direction is expressed by a face mark. In this case, since a power per angle of the non-directional noise source is smaller than the human voice as the directional target sound, a beamformer is configured to minimize the output power, thus automatically forming the null in the −30° target sound direction. A beamformer which automatically forms the null of the beam pattern by a rule such as output power minimization is called an "adaptive beamformer". The adaptive beamformer is suited to extraction of non-directional noise since the beam pattern, the null of which is directed in the target sound direction, as shown in FIG. 2A, can be automatically obtained.

However, the adaptive beamformer suffers the following problems.

For example, in case of wind noise, since a power per angle in a low-frequency range is very strong although wind noise is non-directional, the power per angle has a magnitude comparable to the directional target sound in the low-frequency range, as illustrated in FIG. 2B. FIG. 2B illustrates a beam pattern at about 470 Hz corresponding to a relatively low-frequency range of that of the adaptive beamformer formed with respect to a human voice under wind noise. At this frequency, since a power in the target sound direction is not specially larger than those in other direction, a null becomes very moderate compared to FIG. 2A at about 3.3 kHz corresponding to a mid-to-high frequency range. For this reason, since a target sound cannot be sufficiently removed, and is mixed in extracted noise, the target sound is reduced in the subsequent noise subtraction.

Contrary to the adaptive beamformer which automatically forms a null of a beam pattern, a beamformer which fixedly forms a null in a specific direction is called a "fixed beamformer". Japanese Patent Laid-Open No. 2003-271191 discloses a method of selectively using the adaptive beamformer and fixed beamformer for respectively frequencies upon extraction of noise using the beamformer from microphone signals acquired by a microphone array.

However, the method of Japanese Patent Laid-Open No. 2003-271191 suffers the following problems.

As for the method of the adaptive beamformer, a method using a Jim-Griffith adaptive beamformer is disclosed. This method is based on the output power minimization rule, and a null of a beam pattern is automatically formed. However, a direction of a main lobe has to be designated as a constraint for setting a filter coefficient vector of the beamformer as a non-zero vector. However, in non-directional noise extraction, since only a null to be directed to a directional target sound is originally required, if the direction of the main lobe is explicitly designated, it may influence the beam pattern, thus lowering a target sound suppression performance.

Also, as for the fixed beamformer, a method based on simple differences between channels of microphone signals is disclosed. However, with this method, a null is formed in a direction of a perpendicular bisector of a line segment which connects microphones, and is not directed in the target sound direction. Hence, a target sound is mixed in extracted noise at a high possibility.

Furthermore, as for the selection method of the adaptive beamformer and fixed beamformer, a method of selecting a beamformer having a smaller output power for each frequency range is disclosed. However, as described above, the null of the fixed beamformer is not always directed to the target sound direction, and only an output power is checked. Hence, this selection method is not always suitable to remove a target sound and to extract only noise.

SUMMARY OF THE INVENTION

The present invention has been made to solve the aforementioned problems. That is, the present invention provides a noise suppression apparatus which can extract only non-directional noise from an audio signal without mixing any directional target sound, and can accurately suppress only noise from the audio signal.

According to one aspect of the present invention, a noise suppression apparatus comprises an acquisition unit configured to acquire a plurality of microphone signals acquired by a plurality of microphones, an adaptive beamformer configured to automatically form a null of a beam pattern in a direction of a directional target sound so as to obtain noise-extracted signals by extracting non-directional noise from the plurality of microphone signals, a fixed beamformer configured to form a null of a beam pattern in a designated direction, and a selection unit configured to select the adaptive beamformer or the fixed beamformer as a beamformer to be used for each frequency, wherein the designated direction is determined from a direction of the null automatically formed by the adaptive beamformer.

Further features of the present invention will become apparent from the following description of exemplary embodiments (with reference to the attached drawings).

DESCRIPTION OF THE EMBODIMENTS

Various exemplary embodiments, features, and aspects of the invention will be described in detail below with reference to the drawings.

The present invention will be described in detail hereinafter based on its preferred embodiments with reference to the accompanying drawings. Note that arrangements described in the following embodiments are presented only for the exemplary purpose, and the present invention is not limited to the illustrated arrangement.

As described above, the present invention provides a noise suppression apparatus which can extract only non-directional noise from an audio signal without mixing any directional target sound, and can accurately suppress only noise from the audio signal. The noise suppression apparatus according to an embodiment selectively uses an adaptive beamformer and fixed beamformer for respective frequencies. At this time, a direction of a null of the fixed beamformer is determined from a direction of a null automatically formed by the adaptive beamformer. Furthermore, filter coefficients of the adaptive beamformer based on the output power minimization rule are calculated by the minimum norm method using a norm of the filter coefficients as a constraint.

First Embodiment

Figure 1:
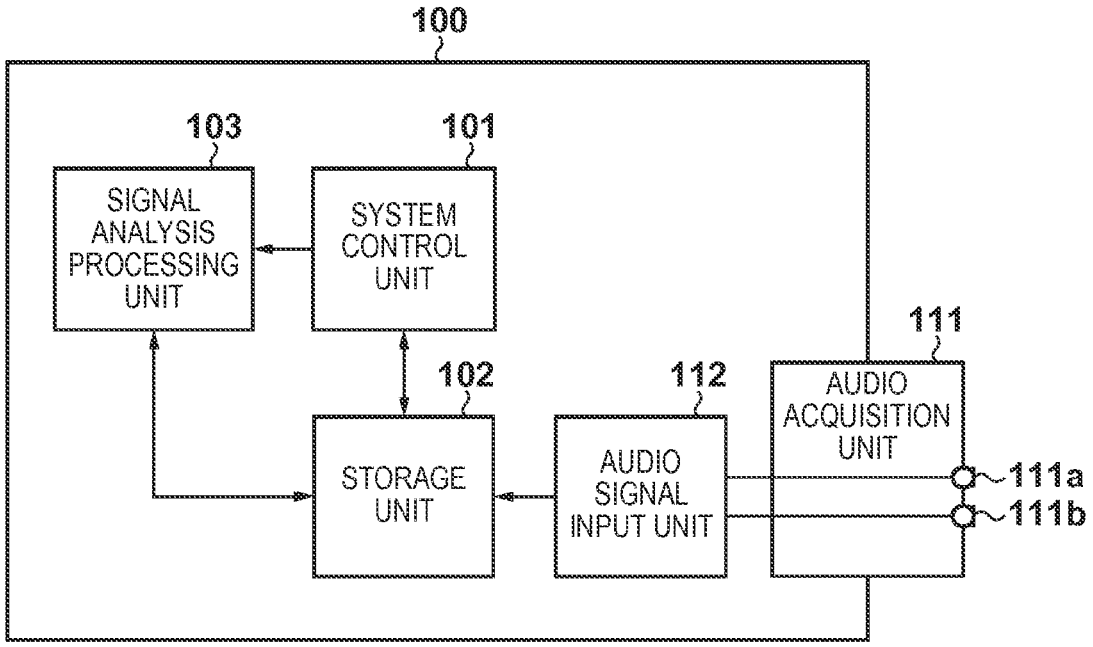
FIG. 1 is a block diagram of a noise suppression apparatus according to an embodiment.

FIG. 1 is a block diagram showing an embodiment of the present invention. In a noise suppression apparatus shown in FIG. 1, a principal system controller 100 includes a system control unit 101 which controls all components, a storage unit 102 which stores various data, and a signal processing unit 103 which executes signal analysis processing.

The noise suppression apparatus includes an audio acquisition unit 111 and audio signal input unit 112 as components which implement functions of an audio acquisition system. In this embodiment, the audio acquisition unit 111 is configured by a 2ch stereo microphone including two microphone elements 111*a* and 111*b* which are disposed to be spaced apart from each other. Assume that the position coefficients of the respective microphone elements are held in advance in the storage unit 102. Alternatively, the position coefficients may be externally input via a data input/output unit (not shown) which is mutually connected to the storage unit 102. The audio signal input unit 112 amplifies and A/D-converts analog audio signals from the respective microphone elements of the audio acquisition unit 111, thereby generating 2ch microphone signals as digital audio signals with a period corresponding to a predetermined sampling rate. Note that the number of microphone elements need only be plural, and three or more microphone elements may be used. That is, the present invention is not limited to the case in which the number of microphone elements is two.

Figure 3:
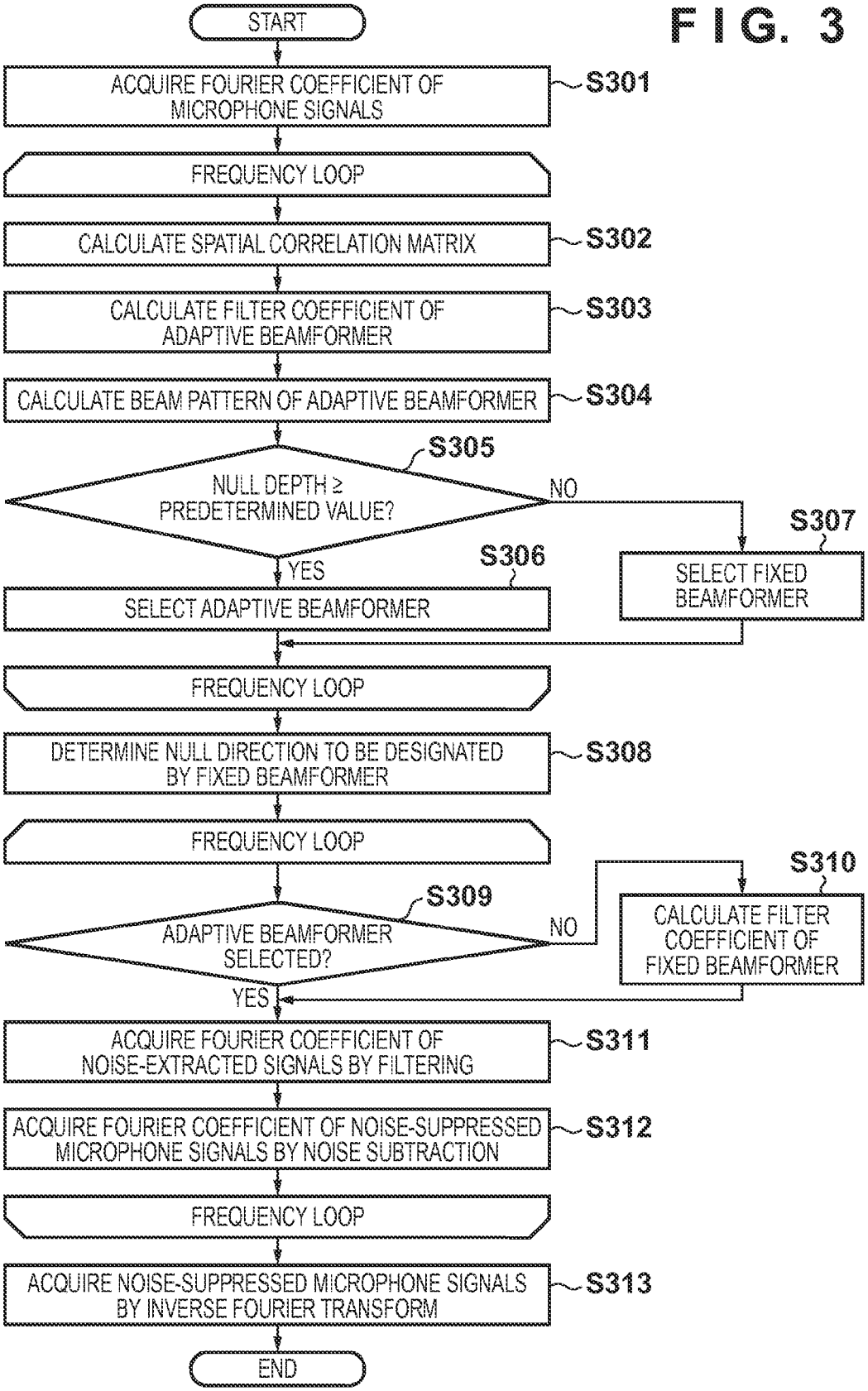
FIG. 3 is a flowchart showing noise suppression processing according to the first embodiment.

In this embodiment, assume that a human voice in a −30° direction as a directional target sound and wind noise as non-directional noise are mixed and input to the stereo microphone. 2ch microphone signals acquired by the audio acquisition system are sequentially recorded in the storage unit 102, and noise suppression processing according to this embodiment is executed according to the flowchart shown in FIG. 3 mainly using the signal processing unit 103. Note that the following description will be given under the assumption that an audio sampling rate is 48 kHz.

A signal sample unit for executing filtering of microphone signals in a beamformer will be referred to as a time block, and in this embodiment, a time block length is 1024 samples (about 21 ms). While shifting a signal sample range by 512 samples (about 11 ms) as a half of the time block length, filtering of microphone signals is executed in a time block loop. That is, the 1st to 1024th samples of microphone signals are filtered in a first time block, and the 513th to 1536th samples are filtered in a second time block.

Assume that the flowchart shown in FIG. 3 expresses processing in one time block in the time block loop.

Initially, in step S301, 2ch microphone signals are Fourier-transformed to acquire Fourier coefficients. In this case, since averaging processing is required to calculate a spatial correlation matrix as a statistical amount in the next step S302, a unit called a time frame with reference to the current time block is introduced. A time frame length is the same as the time block length, that is, 1024 samples, and a signal sample range which is shifted by a predetermined time frame shift length with reference to the signal sample range of the current time block is used as a time frame. In this embodiment, assume that the time frame shift length is 32 samples, and the number of time frames corresponding to the number of times of averaging is 128. That is, in the first time block, a first time frame targets at the 1st to 1024th samples of microphone signals as in the first time block, and a second time frame targets at 33rd to 1056 samples. Then, since the 128th time frame targets at the 4065th to 5088th samples, a spatial correction matrix of the first time block is calculated from microphone signals for 106 ms as the 1st to 5088th samples. Note that the time frame may be a signal sample range before the current time block.

Based on the above description, in step S301, a Fourier coefficient at a frequency f and in a time frame k in association with a current time block of a microphone signal of an i-th channel is obtained as $Z_i(f,k)$ (i=1, 2, k=1 to 128). Note that a window can be applied to microphone signals before Fourier transform. The window can also be applied to time signals restored by inverse Fourier transform. For this reason, a sine window or the like is used as a window function in consideration of reconstruction conditions in two windowing processes for time blocks which overlap each other by 50%.

Steps S302 to S307 are processes for each frequency, and are executed in a frequency loop.

In step S302, a spatial correlation matrix as a statistical amount which expresses spatial properties of microphone signals is calculated. Fourier coefficients of the respective channels calculated in step S301 are combined to generate a vector, which is given by $z(f,k)=[Z_1(f,k)\ Z_2(f,k)]^T$. Using z(f,k), a matrix $R_k(f)$ at a frequency f and in a time frame k is defined like:

$$R_k(f)=z(f,k)z^H(f,k) \tag{1}$$

where superscript T represents transposition, and superscript H represents complex conjugate transposition.

A spatial correlation matrix R(f) is obtained by averaging $R_k(f)$ in association with all time frames, that is, by adding $R_1(f)$ to $R_{128}(f)$ and dividing the sum by 128.

In step S303, filter coefficients of an adaptive beamformer are calculated. Let Wi(f) (i=1, 2) be a filter coefficient used to filter a microphone signal of an i-th channel, and a filter coefficient vector of the beamformer is given by $w(f)=[W_1(f)\ W_2(f)]^T$.

In this embodiment, the filter coefficients of the adaptive beamformer are calculated by the minimum norm method. This is based on the output power minimization rule, and a constraint for setting w(f) as a non-zero vector is described by designating not a main lobe direction but a filter coefficient norm. Thus, the main lobe direction, which is originally not necessary in extraction of non-directional noise, need not be designated. Since an average output power at a frequency f of the beamformer is expressed by $w^H(f)R(f)w(f)$, the filter coefficients of the adaptive beamformer by the minimum norm method are obtained as a solution of a constrained optimization problem given by:

$$\min_w w(f)^H R(f) w(f) \quad \text{subject to } w(f)^H w(f) = 1 \tag{2}$$

This is a minimization problem of a quadratic form using an Hermitian matrix R(f) as a coefficient matrix. Therefore, an eigenvector corresponding to a minimum eigenvalue of R(f) is a filter coefficient vector $w_{adapt}(f)$ of the adaptive beamformer, which is calculated by the minimum norm method.

In step S304, a beam pattern of the adaptive beamformer is calculated. Using the filter coefficient vector $w_{adapt}(f)$ of the adaptive beamformer calculated in step S303, a value $\Psi(f,\theta)$ of an azimuth θ direction of the beam pattern is obtained by:

$$\Psi(f,\theta)=w_{adapt}^H(f)a(f,\theta) \tag{3}$$

where a(f,θ) is an array manifold vector given by:

$$a(f,\theta)=\exp(-j2f\tau(\theta)) \tag{4}$$

where j represents an imaginary unit. Also, a vector which combines transmission delay times $\tau_i(\theta)$ (i=1, 2) from an azimuth θ point on a unit sphere having an origin of a coefficient system used to describe the microphone position coordinates as the center to the respective microphone elements is given by $\tau(\theta)=[\tau_1(\theta)\tau_2(\theta)]^T$.

By calculating Ψ(f,θ) while changing θ from −180° to 180°, a beam pattern in the horizontal direction can be obtained. Note that focusing attention on symmetry of the beam pattern, only a beam pattern from −90° to 90° via 0° may be calculated. Also, in order to accurately recognize a depth of a null of the beam pattern to be checked in the next step S305, Ψ may be calculated by decreasing θ intervals around the null where Ψ becomes small. Furthermore, in addition to the azimuth θ, by calculating Ψ(f,θ,ϕ) while changing an elevation ϕ from −90° to 90° except for 0°, an omnidirectional beam pattern including not only the horizontal direction but also the vertical direction can be targeted.

In step S305, a depth of a null of the beam pattern formed by the adaptive beamformer is checked.

Figure 2A:
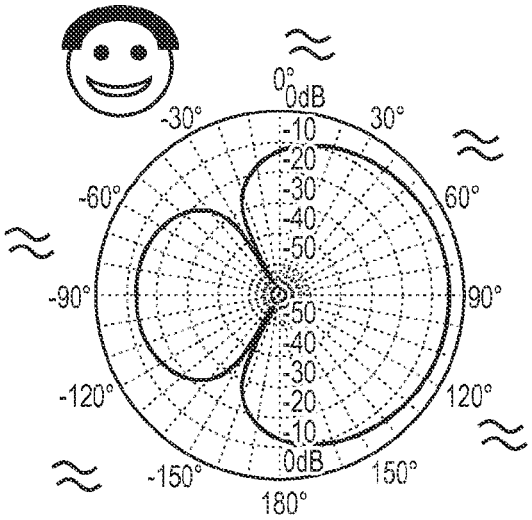
FIGS. 2A to 2C are charts for explaining a beam pattern.
Figure 4A:
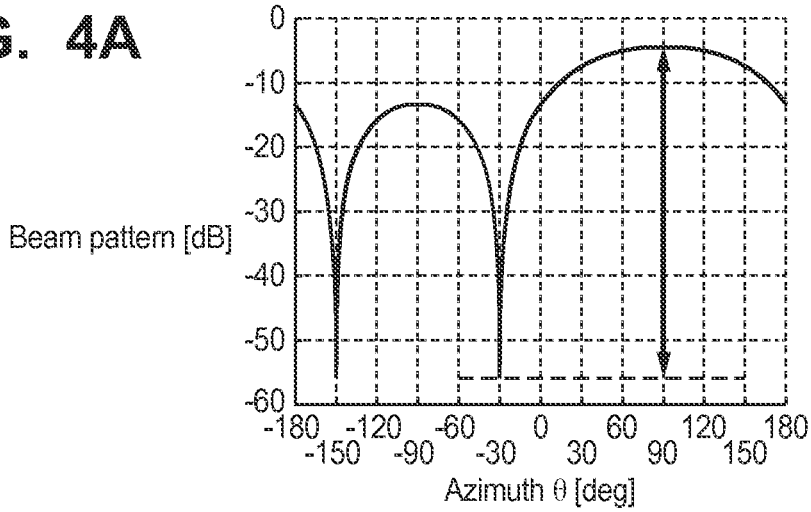
FIGS. 4A to 4C are graphs for explaining a depth and direction of a null according to the first embodiment.

FIG. 4A shows a beam pattern at a certain frequency, which is calculated in step S304, on an orthogonal coordinate system, and this beam pattern corresponds to that on the polar coordinate system shown in FIG. 2A. As can be seen from FIG. 4A, since a null which is deep in the target sound direction is automatically formed by the adaptive beamformer, only wind noise may be extracted without mixing any target sound at this frequency. In this case, as indicated by a bidirectional arrow in FIG. 4A, a difference between maximum and minimum values of the beam pattern is defined as a depth of a null. If the depth of the null is not less than a predetermined value (for example, 20 dB or more), the process advances to step S306 to select the adaptive beamformer at this frequency.

Figure 2B:
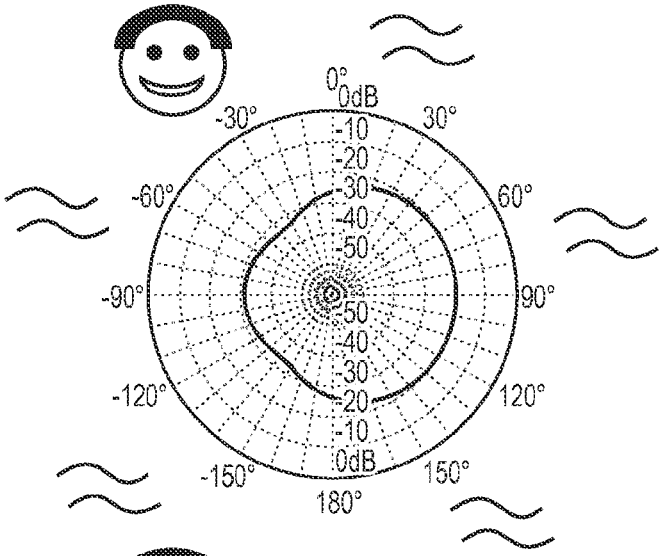
Figure 4B:
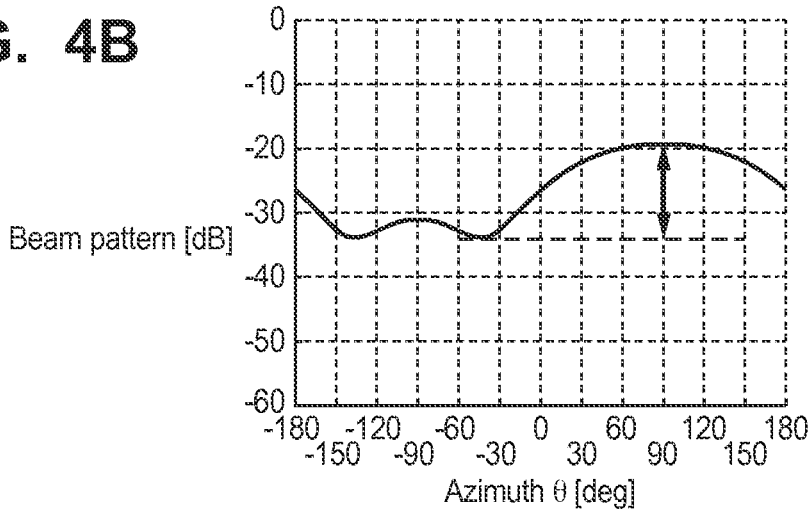

On the other hand, FIG. 4B shows a beam pattern at another frequency, which is calculated in step S304, and this beam pattern corresponds to that on the polar coordinate system shown in FIG. 2B. As can be seen from FIG. 4B, since a null automatically formed by the adaptive beamformer is shallow and moderate, a target sound may be mixed upon extraction of wind noise at this frequency. Hence, if the depth of the null is less than the predetermined value (for example, less than 20 dB), the process advances to step S307 to select the fixed beamformer which fixedly forms a null in a designated direction at this frequency.

In step S308, a null direction (designated direction) in which a null is to be formed, and which is to be designated when the fixed beamformer is used is determined. In the present invention, the null direction of the fixed beamformer is determined from beam patterns of frequencies at which the null of the adaptive beamformer checked in step S305 is deep, and the adaptive beamformer is selected in step S306.

When a null automatically formed by the adaptive beamformer is shallow, that null direction may be deviated from the target sound direction)(−30°, as shown in FIG. 4B. On the other hand, when a deep null is automatically formed by the adaptive beamformer, that null direction may approximately point to the target sound direction, as shown in FIG. 4A. Hence, beam patterns of frequencies at which the adaptive beamformer is selected in step S306 are averaged, and a null direction in which this average beam pattern assumes a minimum value is set as a null direction $\theta_{null}$ to be designated by the fixed beamformer. That is, slightly different null directions at respective frequencies are converged by averaging to obtain a representative value to be used for the fixed beamformer. Note that $\theta_{null}$ need not always be calculated using beam patterns of all frequencies at which the adaptive beamformer is selected, and only frequencies at which the adaptive beamformer is selected may be used within, for example, a range of a principal frequency band of a voice as a target sound.

Figure 4C:
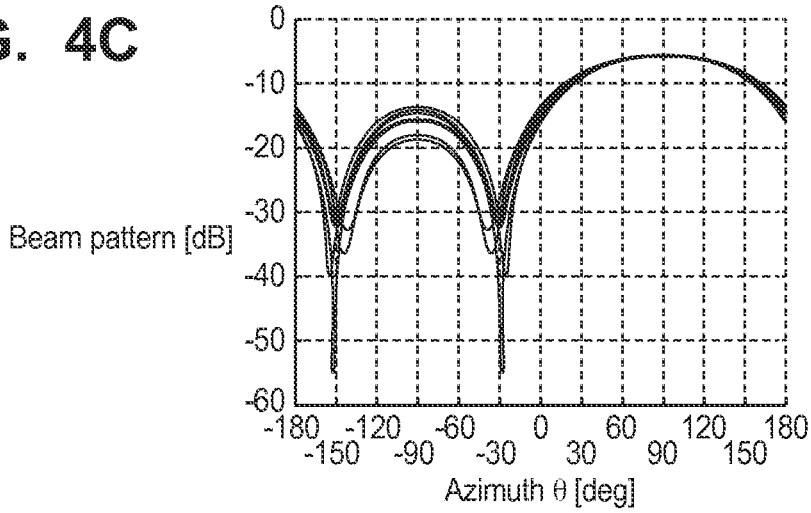

FIG. 4C shows an example of averaging of beam patterns in this step. Thin curves in FIG. 4C represent beam patterns of some frequencies at which the adaptive beamformer is selected, and a bold curve represents an average beam pattern obtained by averaging them. From the null direction of this average beam pattern, a null direction $\theta_{null}=-30°$ to be designated by the fixed beamformer is calculated.

Steps S309 to S312 are processes for each frequency again, and are executed in a frequency loop.

In step S309, if the adaptive beamformer is not selected at the frequency of the current loop, since the fixed beamformer is selected, the process advances to step S310, and filter coefficients of the fixed beamformer are required to be calculated.

In step S310, using the null direction $\theta_{null}$ to be designated by the fixed beamformer, which is determined in step S308, filter coefficients $w_{fix}(f)$ of the fixed beamformer are calculated.

A condition required to form a null in the null direction $\theta_{null}$ in a beam pattern of the fixed beamformer is expressed, using an array manifold vector a $(f,\theta_{null})$, by:

$$w_{fix}^{H}(f)a(f,\theta_{null})=0 \tag{5}$$

However, since a solution becomes a zero vector by equation (5) alone, a condition required to form a main lobe in a main lobe direction $\theta_{main}$ is added. This condition is expressed by:

$$w_{fix}^{H}(f)a(f,\theta_{main})=1 \tag{6}$$

Note that the main lobe direction $\theta_{main}$ is defined in a direction opposite to the null direction $\theta_{null}$ or the like.

When equations (5) and (6) are combined and are expressed using a matrix $A(f)=[a(f,\theta_{null})\ a(f,\theta_{main})]$, we have:

$$A^{H}(f)w_{fix}(f)=\begin{bmatrix}0\\1\end{bmatrix} \tag{7}$$

Hence, by multiplying the two sides of equation (7) by an inverse matrix of $A^{H}(f)$, the filter coefficients $w_{fix}(f)$ of the fixed beamformer are obtained. Since a norm of $w_{fix}(f)$ is different for each frequency, the norm can be normalized the norm to 1 as in the adaptive beamformer. Note that when the number of elements of the filter coefficient vector $w_{fix}(f)$, that is, the number of microphone elements of the audio acquisition unit 111 is different from the number of control points on the beam pattern like equations (5) and (6), since A(f) is not a square matrix, a generalized inverse matrix is used.

Figure 2C:
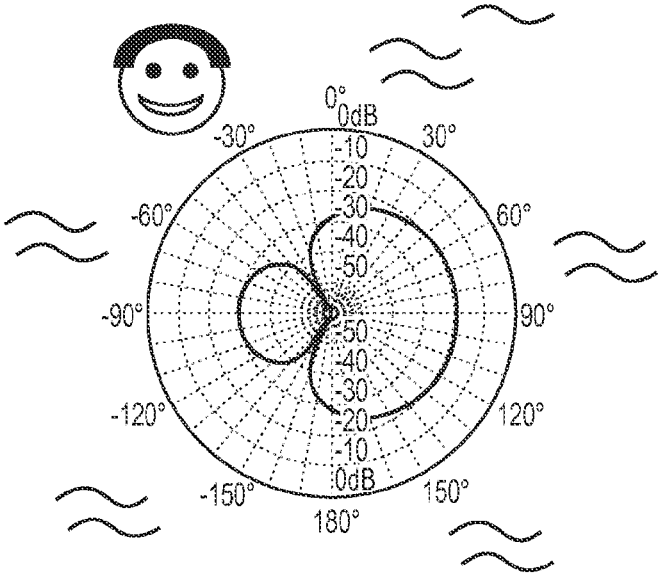

Like in this step, this embodiment uses the fixed beamformer which forms a null in the direction $\theta_{null}$ Thus, even at a frequency at which the adaptive beamformer forms the beam pattern shown in FIG. 2B, a beam pattern formed with a sharp null in the target sound direction, as shown in FIG. 2C, is obtained. Therefore, only wind noise can be extracted without mixing any target sound in the next step S311.

In step S311, Fourier coefficients Y(f) of noise-extracted signals are acquired by filtering the microphone signals, as given by:

$$Y(f)=w^{H}(f)z(f) \tag{8}$$

for z(f)=z(f,1).

The filter coefficients w(f) of the beamformer use $w_{adapt}(f)$ at a frequency at which the adaptive beamformer is selected, and $w_{fix}(f)$ at a frequency at which the fixed beamformer is selected.

In step S312, noise extracted in step S311 is subtracted from the microphone signals in a frequency domain, thus acquiring Fourier coefficients $X_i(f)$ (i=1, 2) of the noise-suppressed microphone signals in which noise is suppressed. A noise subtraction is attained by a spectrum subtraction or the like, which is expressed by:

$$X_i(f)=\begin{cases}(|Z_i(f)|-\beta|Y(f)|)\exp(j\arg(Z_i(f))) & (\text{if } |Z_i(f)|-\beta|Y(f)|>0)\\ \eta Z_i(f) & (\text{otherwise})\end{cases} \tag{9}$$

Note that since $Z_i(f)=Z_i(f,1)$ (i=1, 2), an amplitude spectrum is expressed by an absolute value symbol, and a phase spectrum is expressed by arg. Also, β is a subtraction coefficient used to adjust a subtraction strength, and η is a flooring coefficient required to assure a slight output when the subtraction result does not assume a positive value.

Since only wind noise can be extracted without mixing any target sound in step S311, wind noise alone can be accurately suppressed without reducing any target sound in the noise subtraction of this step.

In step S313, the Fourier coefficients of the noise-suppressed microphone signals acquired in step S312 are inversely Fourier-transformed to acquire noise-suppressed microphone signals in the current time block. Windowing is applied to these signals to overlap-add them to noise-suppressed microphone signals until the previous time block, and the obtained noise-suppressed microphone signals are sequentially recorded in the storage unit 102. The noise-suppressed microphone signals obtained in this way can be externally output via the data input/output unit or can be reproduced by an audio reproduction system (not shown) such as earphones.

Second Embodiment

In the above embodiment, whether to select an adaptive beamformer or fixed beamformer is judged for each frequency. In the following embodiment, a switching frequency of beamformers is introduced in consideration of the tendency that the power of wind noise assumed as a practical example of non-directional noise becomes stronger as a frequency is lower.

That is, in a frequency range not less than the switching frequency, the power of wind noise is smaller than a target sound, as shown in FIG. 2A, and it is considered that the adaptive beamformer automatically forms a sharp null in a target sound direction, thus selecting the adaptive beamformer. On the other hand, in a frequency range less than the switching frequency, it is considered that the power of wind noise is comparable to the target sound, and a moderate null is automatically formed by the adaptive beamformer, thus selecting the fixed beamformer, as shown in FIG. 2B.

Figure 5:
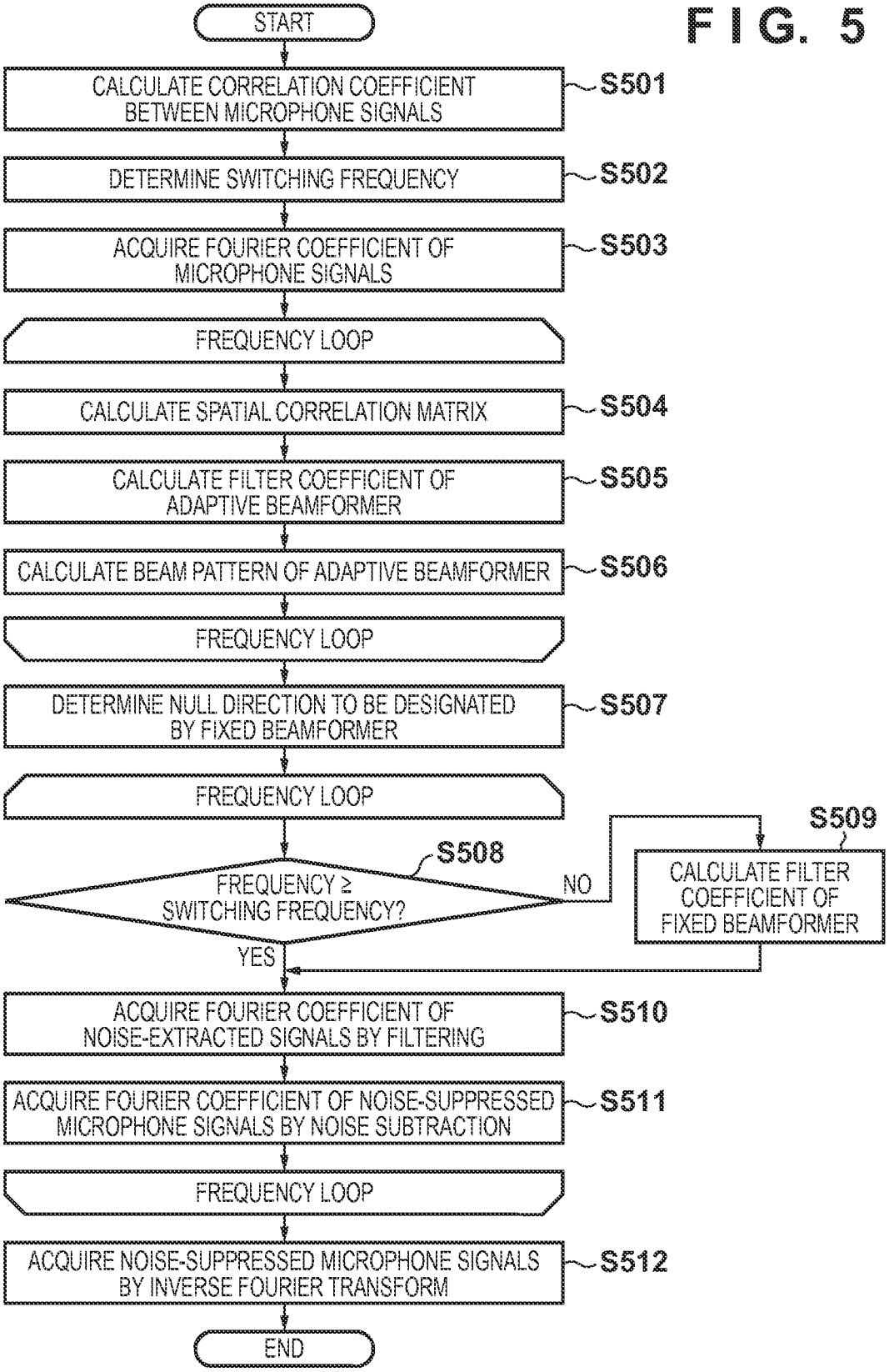
FIG. 5 is a flowchart showing noise suppression processing according to the second embodiment.

As the switching frequency, for example, a predetermined value such as 1 kHz may be fixedly used. However, in this embodiment, the switching frequency is determined from a correlation coefficient between respective microphone signals, and noise suppression processing is executed according to the flowchart shown in FIG. 5.

In step S501, a correlation coefficient between microphone signals is calculated from respective microphone signals within a signal sample range of the current time block. Since the correlation coefficient is calculated for a combination of two channels of the microphone signals, if the number of microphone elements is M, ${}_{M}C_{2}$ correlation coefficients are obtained. In case of a stereo microphone, the number of correlation coefficients is one.

Figure 6:
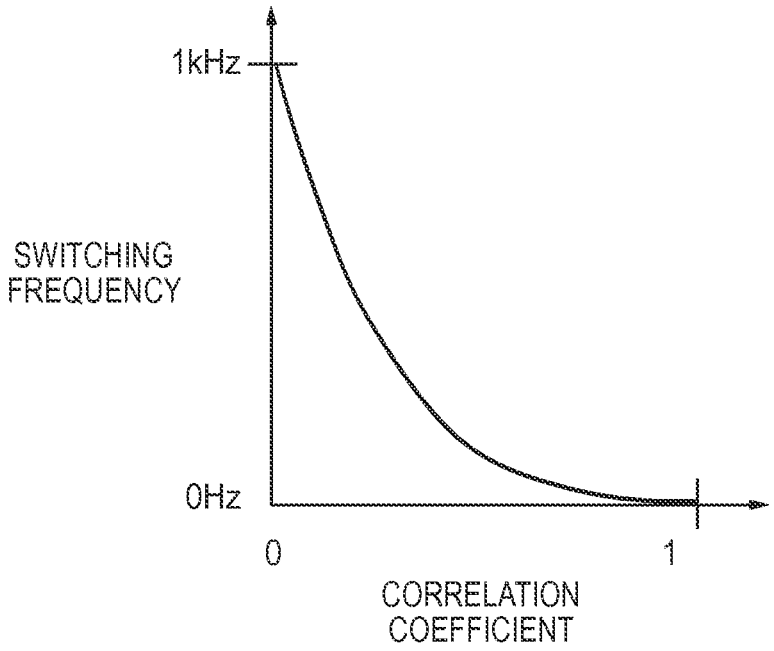
FIG. 6 is a graph showing a relationship example between a correlation coefficient between a plurality of microphone signals and a switching frequency according to the second embodiment.

In step S502, a switching frequency is determined from the correlation coefficient calculated in step S501 using a relationship expressed by a graph shown in FIG. 6. Note that when three or more microphone elements are used, and a plurality of correlation coefficients are obtained, their average value can be used. When the correlation coefficient assumes a negative values, an absolute value is calculated or "0" is used.

A shape of the graph shown in FIG. 6 is determined based on the following concept. Initially, since a directional target sound has a high correlation between microphones, a correlation coefficient assumes a value closer to 1. On the other hand, since non-directional wind noise has a low correlation between microphones, a correlation coefficient assumes a value closer to 0. Hence, as the correlation coefficient becomes closer from 1 to 0, it is determined that wind noise is stronger than the target sound, and a ratio of frequencies at which the fixed beamformer is selected is increased by increasing the switching frequency. Especially, when the correlation coefficient assumes a value closer to 1, the switching frequency is set at 0 Hz, and the adaptive beamformer alone is used. When the correlation coefficient assumes 0, the switching frequency is set at 1 kHz in consideration of a principal frequency band of wind noise.

Since the process of step S503 is the same as that of step S301, a description thereof will not be repeated.

Steps S504 to S506 are processes for each frequency, and are executed in a frequency loop. Since these processes are associated with the adoptive beamformer, they need only be executed at a frequency not less than the switching frequency determined in step S502. Note that the processes of steps S504 to S506 are the same as those of steps S302 to S304.

Since the process of step S507 is the same as that of step S308, a description thereof will not be repeated.

Steps S508 to S511 are processes for each frequency, and are executed in the frequency loop. In step S508, if a frequency of the current loop is less than the switching frequency, since the fixed beamformer is selected, the process advances to step S509, and filter coefficients of the fixed beamformer are required to be calculated. Note that the processes of steps S509 to S511 are the same as those of steps S310 to S312.

Since the process of the last step S512 is the same as that of step S313, a description thereof will not be repeated.

Third Embodiment

Figure 7:
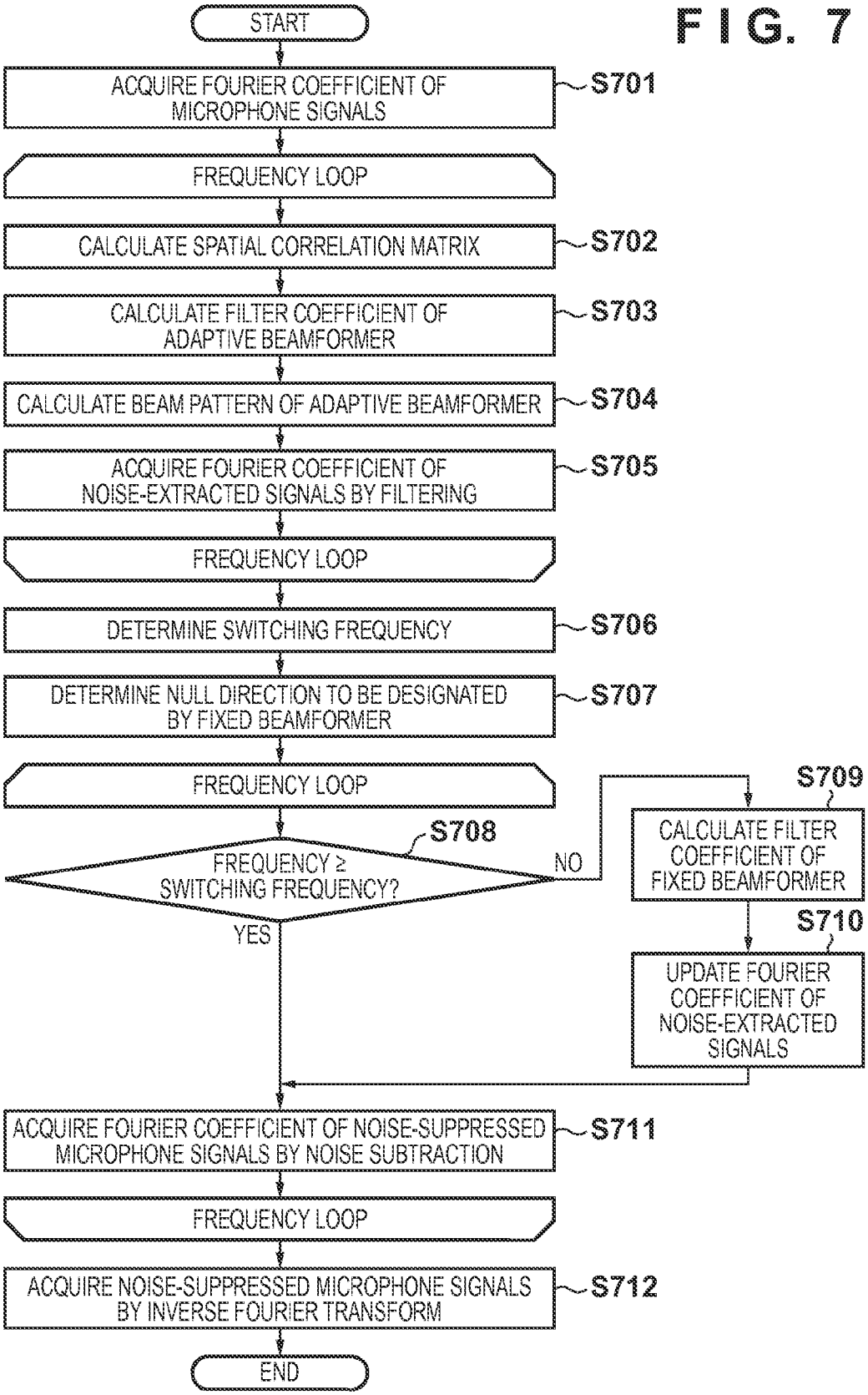
FIG. 7 is a flowchart showing noise suppression processing according to the third embodiment.

In this embodiment, a switching frequency is determined from noise extracted by an adaptive beamformer, and noise suppression processing is executed according to the flowchart shown in FIG. 7.

Since the process of step S701 is the same as that of step S301, a description thereof will not be repeated.

Steps S702 to S705 are processes for each frequency, and are executed in a frequency loop. The processes of steps S702 to S704 are the same as those of steps S302 to S304.

In step S705, by filtering microphone signals, as given by equation (8), Fourier coefficients Y(f) of noise-extracted signals are acquired. However, since filter coefficients of a beamformer calculated at this time are $w_{adapt}$ only, noise extraction is executed by the adaptive beamformer alone.

In step S706, a switching frequency is determined from the Fourier coefficients of the noise-extracted signals acquired in step S705.

Figure 8:
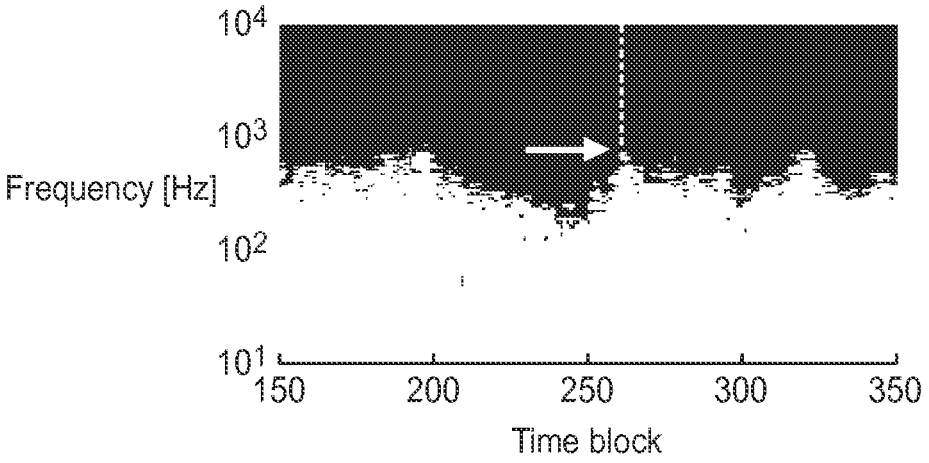
FIG. 8 is a graph showing a relationship example between amplitude spectra of noise and a switching frequency according to the third embodiment.

FIG. 8 shows a spectrogram which displays amplitude spectra obtained from the Fourier coefficients of the noise-extracted signals over a plurality of time blocks. Amplitude spectrum values in dB are displayed while being binarized by a threshold of a predetermined level, so that a white part indicates a larger level, and a black part indicates a smaller level. As can be seen from FIG. 8, an amplitude spectrum envelope of wind noise is obtained.

Since nearly no stripe pattern formed by a harmonic structure of a voice as a target sound is observed at frequencies above the amplitude spectrum envelope, it is determined that the adaptive beamformer can extract wind noise alone. However, since wind noise becomes considerably strong at frequencies below the amplitude spectrum envelope, a voice is unwantedly mixed at a high possibility although it is hidden by large amplitude spectra of wind noise.

Hence, in this embodiment, the switching frequency of beamformers is determined from the amplitude spectrum envelope of noise extracted by the adaptive beamformer, and a fixed beamformer is used at frequencies less than the switching frequency.

As practical processing of this step, for example, assuming that the current time block is indicated by the dotted line in FIG. 8, a maximum frequency at which a level of the amplitude spectra of noise is not less than the threshold is set as the switching frequency, and a switching frequency of about 710 Hz indicated by an arrow in FIG. 8 is set in this case.

Since the process of step S707 is the same as that of step S308, a description thereof will not be repeated.

Steps S708 to S711 are processes for each frequency again, and are executed in the frequency loop. In step S708, if a frequency of the current loop is less than the switching frequency, since the fixed beamformer is selected, the process advances to step S709, and filter coefficients of the fixed beamformer are required to be calculated. Note that the process of step S709 is the same as that of step S310.

In step S710, Fourier coefficients Y(f) of noise-extracted signals, which have already been acquired using filter coefficients $w_{adapt}(f)$ of the adaptive beamformer in step S705, are updated by those acquired using filter coefficients $w_{fix}(f)$ of the fixed beamformer. Note that the process of step S711 is the same as that of step S312.

Since the process of the last step S712 is the same as that of step S313, a description thereof will not be repeated.

Fourth Embodiment

Figure 9:
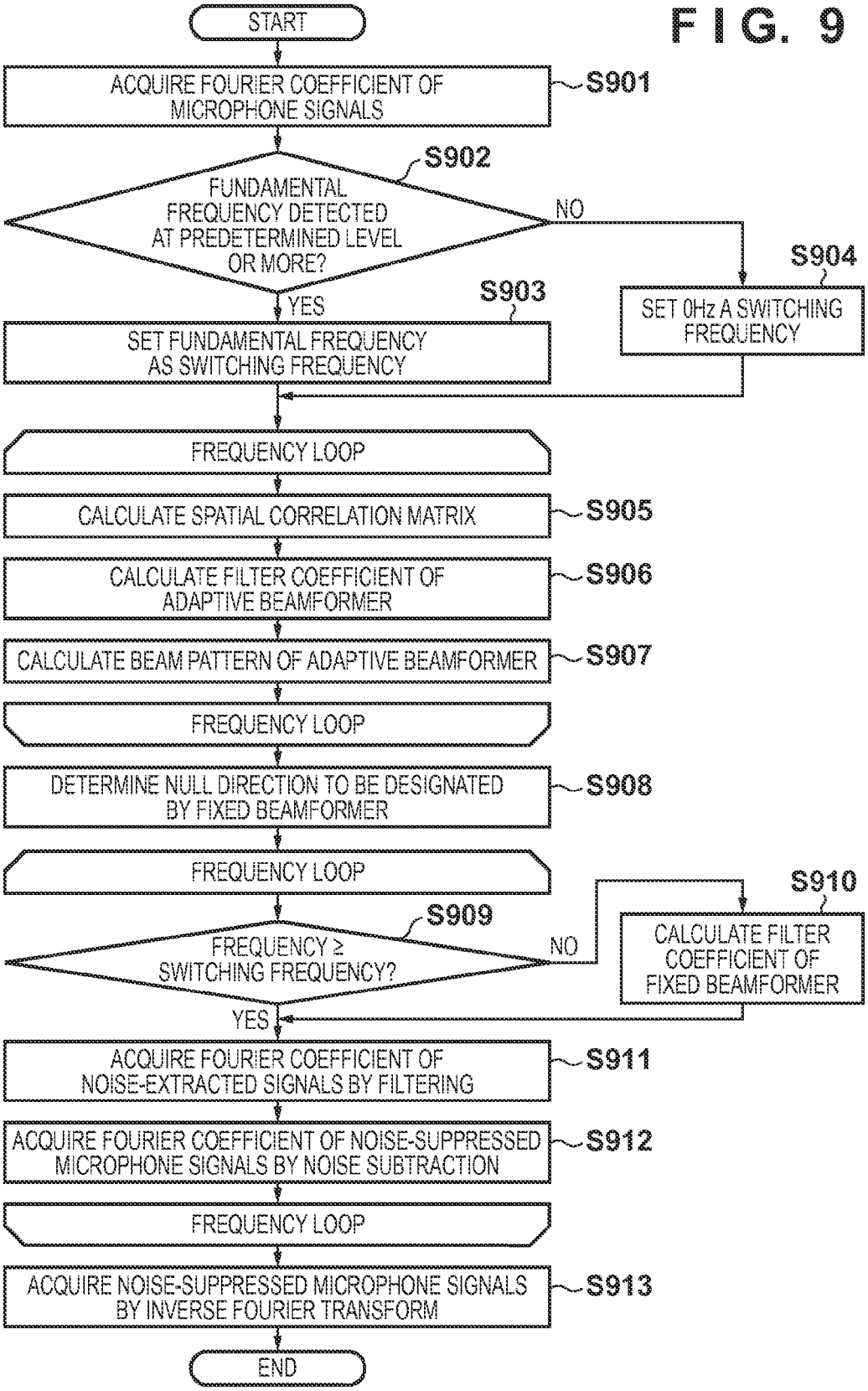
FIG. 9 is a flowchart showing noise suppression processing according to the fourth embodiment.

In this embodiment, a switching frequency is determined from a fundamental frequency detected from microphone signals, and noise suppression processing is executed according to the flowchart shown in FIG. 9.

Since the process of step S901 is the same as that of step S301, a description thereof will not be repeated.

In step S902, a fundamental frequency of a voice as a target sound is detected from Fourier coefficients $Z_i(f,1)$ (i=1, 2) of respective microphone signals in the current time block acquired in step S901.

Figure 10:
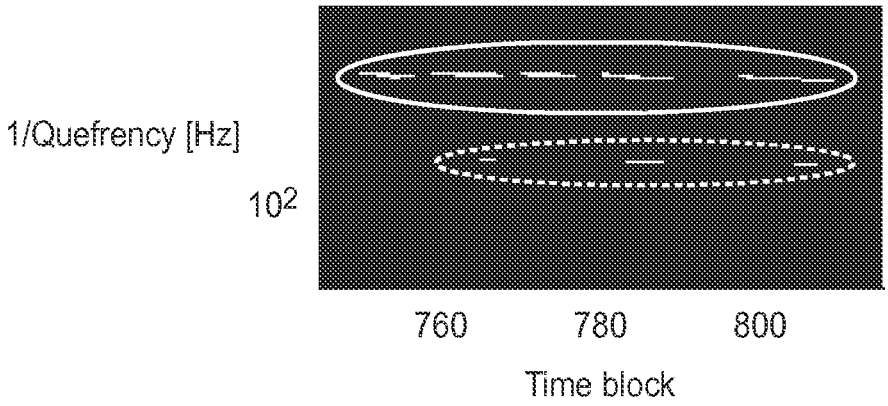
FIG. 10 is a graph showing a relationship example between a fundamental frequency and switching frequency according to the fourth embodiment.

FIG. 10 displays real number cepstra calculated from $Z_1(f, 1)$ of ch1 over a plurality of time blocks. Real number cepstrum values in dB are displayed while being binarized by a threshold of a predetermined level, so that a white part indicates a larger level, and a black part indicates a smaller level. The ordinate of a graph assumes a dimension of a frequency as a reciprocal of a frequency, and represents a fundamental frequency when the amplitude spectra have a harmonic structure.

Horizontal lines (about 285 Hz) bounded by a solid oval in FIG. 10 may indicate a frequency at which levels of real number cepstra are not less than the threshold, and represent the fundamental frequency of a voice included in the microphone signal. In a time block in which the fundamental frequency is detected in this step in this way, the process advances to step S903 to set the fundamental frequency as a switching frequency of beamformers. This is based on the concept that as wind noise is stronger than a voice, the fundamental frequency is harder to be detected, but when the fundamental frequency can be detected at the predetermined level or more, only wind noise can be detected by the adaptive beamformer.

Note that when the binarization threshold is lowered more in FIG. 10, horizontal lines (about 142 Hz) bounded by a dotted oval appear. In this manner, even at frequencies lower than the fundamental frequency (about 285 Hz) detected at the predetermined level or more, a voice as a target sound is often included. Hence, it is significant to form a null in a target sound direction by the fixed beamformer.

Note that when a plurality of fundamental frequencies are detected in one channel in one time block, the lowest frequency can be selected as the fundamental frequency. When different fundamental frequencies are detected for respective channels, the highest frequency can be selected as the fundamental frequency.

If the fundamental frequency cannot be detected at the predetermined level or more in step S902, it is determined that the current time block corresponds to an unvoiced period including wind noise alone, and the process advances to step S904 to set the switching frequency at 0 Hz. That is, noise is extracted using only the adaptive beamformer. When no directional target sound exists but only non-directional wind noise exists, directivity need not be set by the beamformer in noise extraction. When only non-directional noise exists in this way, a beam pattern can be formed by the adaptive beamformer has a nearly circular shape on a polar coordinate system.

Note that when the fundamental frequency has been detected in a certain time block before those tracking back by the predetermined number of time blocks, it may be determined that the current time block corresponds to a consonant period in which a harmonic structure is not clear in place of the unvoiced period, and the previous fundamental frequency may be used as the switching frequency.

Since the subsequent processes of steps S905 to S913 are the same as those of steps S504 to S512 of the second embodiment, a description thereof will not be repeated.

In the third embodiment, the switching frequency is determined from the amplitude spectrum envelope of wind noise. On the other hand, in this embodiment, when a fundamental frequency even at a frequency below the amplitude spectrum envelope can be detected, that frequency is set as the switching frequency. Hence, a ratio of frequencies at which the adaptive beamformer is selected tends to increase compared to the third embodiment.

Note that microphone signals need not always be acquired by the noise suppression apparatus of the present invention. For example, multi-channel microphone signals and position coordinates of corresponding microphone elements may be externally acquired via a data input/output unit.

According to the present invention described above, the adaptive beamformer and fixed beamformer are selectively used for respective frequencies, and a null direction of the fixed beamformer is determined from a direction of a null automatically formed by the adaptive beamformer. Furthermore, filter coefficients of the adaptive beamformer based on the output power minimization rule are calculated by the minimum norm method using a norm of the filter coefficients as a constraint. Furthermore, the depth of the null automatically formed by the adaptive beamformer is checked in the above selection. With these processes, only non-directional noise is extracted from audio signals without mixing any directional target sound, and only noise can be accurately suppressed from the audio signals.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-286162, filed Dec. 27, 2012, which is hereby incorporated by reference herein in its entirety.

What is claimed is:

1. A noise suppression apparatus comprising:

an acquisition unit configured to acquire a plurality of microphone signals acquired by a plurality of microphones;

an adaptive beamformer configured to automatically form a null of a beam pattern in a direction of a directional target sound so as to obtain noise-extracted signals by extracting non-directional noise from the plurality of microphone signals;

a fixed beamformer configured to form a null of a beam pattern in a designated direction; and a selection unit configured to select said adaptive beamformer or said fixed beamformer as a beamformer to be used for each frequency, wherein the designated direction is determined from a direction of the null automatically formed by said adaptive beamformer.

2. A noise suppression apparatus comprising:

an acquisition unit configured to acquire a plurality of microphone signals acquired by a plurality of microphones;

an adaptive beamformer configured to automatically form a null of a beam pattern in a direction of a directional target sound so as to obtain noise-extracted signals by extracting non-directional noise from the plurality of microphone signals;

a fixed beamformer configured to form a null of a beam pattern in a designated direction; and a selection unit configured to select said adaptive beamformer or said fixed beamformer as a beamformer to be used for each frequency, wherein filter coefficients of said adaptive beamformer are calculated by a minimum norm method.

3. A noise suppression apparatus comprising:

an acquisition unit configured to acquire a plurality of microphone signals acquired by a plurality of microphones;

an adaptive beamformer configured to automatically form a null of a beam pattern in a direction of a directional target sound so as to obtain noise-extracted signals by extracting non-directional noise from the plurality of microphone signals;

a fixed beamformer configured to form a null of a beam pattern in a designated direction; and a selection unit configured to select said adaptive beamformer or said fixed beamformer as a beamformer to be used for each frequency, wherein filter coefficients of said adaptive beamformer are calculated by a minimum norm method, and the designated direction is determined from a direction of the null automatically formed by said adaptive beamformer.

4. The apparatus according to claim 1, wherein said selection unit selects said fixed beamformer at a frequency at which a difference between a maximum value and a minimum value, which corresponds to a depth of a null in a beam pattern of said adaptive beamformer, is less than a predetermined value.

5. The apparatus according to claim 1, wherein said selection unit selects said adaptive beamformer at a frequency not less than a predetermined switching frequency, and selects the fixed beamformer at a frequency less than the switching frequency.

6. The apparatus according to claim 5, wherein the switching frequency is higher as a correlation coefficient between the plurality of microphone signals is smaller.

7. The apparatus according to claim 5, wherein the switching frequency is a maximum frequency at which an amplitude spectrum of the noise-extracted signals obtained by said adaptive beamformer is not less than a predetermined value.

8. The apparatus according to claim 5, wherein the switching frequency is a fundamental frequency detected from the plurality of microphone signals.

9. The apparatus according to claim 1, further comprising a unit configured to subtract the noise-extracted signals respectively from the plurality of microphone signals.

10. A control method of a noise suppression apparatus having a plurality of microphones, comprising the steps of:

acquiring a plurality of microphone signals acquired by the plurality of microphones;

automatically forming a null of a beam pattern in a direction of a directional target sound using an adaptive beamformer so as to obtain noise-extracted signals by extracting non-directional noise from the plurality of microphone signals;

selecting the adaptive beamformer or a fixed beamformer as a beamformer to be used for each frequency; and forming a null of a beam pattern in a designated direction using the fixed beamformer for a frequency at which the fixed beamformer is selected, wherein the designated direction is determined from a direction of the null automatically formed by the adaptive beamformer.

11. A control method of a noise suppression apparatus having a plurality of microphones, comprising the steps of:

acquiring a plurality of microphone signals acquired by the plurality of microphones;

automatically forming a null of a beam pattern in a direction of a directional target sound using an adaptive beamformer so as to obtain noise-extracted signals by extracting non-directional noise from the plurality of microphone signals;

selecting the adaptive beamformer or a fixed beamformer as a beamformer to be used for each frequency; and forming a null of a beam pattern in a designated direction using the fixed beamformer for a frequency at which the fixed beamformer is selected, wherein filter coefficients of the adaptive beamformer are calculated by a minimum norm method.

12. A control method of a noise suppression apparatus having a plurality of microphones, comprising the steps of:

acquiring a plurality of microphone signals acquired by the plurality of microphones;

automatically forming a null of a beam pattern in a direction of a directional target sound using an adaptive beamformer so as to obtain noise-extracted signals by extracting non-directional noise from the plurality of microphone signals;

selecting the adaptive beamformer or a fixed beamformer as a beamformer to be used for each frequency; and forming a null of a beam pattern in a designated direction using the fixed beamformer for a frequency at which the fixed beamformer is selected, wherein filter coefficients of the adaptive beamformer are calculated by a minimum norm method, and the designated direction is determined from a direction of the null automatically formed by the adaptive beamformer.

13. A non-transitory computer-readable storage medium storing a program for controlling a computer to execute respective steps of a control method of a noise suppression apparatus having a plurality of microphones, the method comprising the steps of:

acquiring a plurality of microphone signals acquired by the plurality of microphones;

automatically forming a null of a beam pattern in a direction of a directional target sound using an adaptive beamformer so as to obtain noise-extracted signals by extracting non-directional noise from the plurality of microphone signals;

selecting the adaptive beamformer or a fixed beamformer as a beamformer to be used for each frequency; and forming a null of a beam pattern in a designated direction using the fixed beamformer for a frequency at which the fixed beamformer is selected, wherein the designated direction is determined from a direction of the null automatically formed by the adaptive beamformer.

* * * * *